US010378487B2

(12) United States Patent
Yoon et al.

(10) Patent No.: US 10,378,487 B2
(45) Date of Patent: Aug. 13, 2019

(54) WATER-COOLED EXHAUST GAS RECIRCULATION COOLER

(71) Applicants: HYUNDAI MOTOR COMPANY, Seoul (KR); KIA MOTORS CORPORATION, Seoul (KR)

(72) Inventors: Sung Il Yoon, Seoul (KR); Dong Young Lee, Goyang-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 15/369,404

(22) Filed: Dec. 5, 2016

(65) Prior Publication Data

US 2018/0073470 A1 Mar. 15, 2018

(30) Foreign Application Priority Data

Sep. 9, 2016 (KR) ..... 10-2016-0116725

(51) Int. Cl.
*F02M 26/32* (2016.01)
*F28D 21/00* (2006.01)

(52) U.S. Cl.
CPC ..... *F02M 26/32* (2016.02); *F28D 21/0003* (2013.01)

(58) Field of Classification Search
CPC ..... F02M 26/32; F02M 26/29; F28D 21/0003
USPC ..... 165/DIG. 486
See application file for complete search history.

(56) References Cited

U.S. PATENT DOCUMENTS 1,401,565 A * 12/1921 Spery ..... F28F 1/126 165/153
6,247,523 B1 * 6/2001 Shibagaki ..... F28D 9/0043 165/51
7,681,629 B2 * 3/2010 Yamaguchi ..... F01N 5/02 165/166
2005/0163677 A1 * 7/2005 Galligan ..... B01D 53/885 422/180
2007/0221181 A1 * 9/2007 Maucher ..... F01N 3/04 123/568.12

(Continued)

FOREIGN PATENT DOCUMENTS

JP 2008-196319 A 8/2008
JP 2010-101239 A 5/2010

(Continued)

*Primary Examiner* — George C Jin
(74) *Attorney, Agent, or Firm* — Morgan Lewis & Bockius LLP

(57) ABSTRACT

A water-cooled exhaust gas recirculation (EGR) cooler, which receives exhaust gas from an exhaust line, and recirculates cooled exhaust gas to an intake line, includes: a housing having an exhaust gas inlet, into which exhaust gas flows, and an exhaust gas outlet, from which exhaust gas is discharged, and further having a coolant inlet, into which a coolant for cooling the exhaust gas flows, and a coolant outlet, from which the coolant is discharged; tubes, each of which has an enclosed tube shape, arranged inside the housing with a first predetermined interval so that exhaust gas passing from the exhaust gas inlet to the exhaust gas outlet flows inside the tubes; and supporters interposed between the tubes to maintain the first predetermined interval between the tubes and support the tubes, and disposed in a space, in which the coolant flows.

10 Claims, 5 Drawing Sheets

(56) References Cited

U.S. PATENT DOCUMENTS

| | | | | |
|---|---|---|---|---|
| 2007/0289581 | A1* | 12/2007 | Nakamura | F28D 9/0025 123/568.12 |
| 2008/0078536 | A1* | 4/2008 | Tolani | F02B 29/0462 165/134.1 |
| 2008/0087409 | A1* | 4/2008 | Nakamura | F28D 9/0025 165/165 |
| 2008/0223563 | A1* | 9/2008 | Penny | B21D 53/04 165/166 |
| 2008/0271722 | A1* | 11/2008 | Grunenwald | F28D 9/0043 123/568.12 |
| 2008/0302094 | A1* | 12/2008 | Yoon | F28D 7/0075 60/320 |
| 2010/0095659 | A1* | 4/2010 | Kuroyanagi | F01N 5/02 60/320 |
| 2011/0247318 | A1* | 10/2011 | Kuroyanagi | F02M 25/0737 60/278 |
| 2015/0184946 | A1* | 7/2015 | Barwig | F02B 29/0462 123/542 |
| 2015/0345361 | A1* | 12/2015 | Ryu | C21D 8/00 428/653 |

FOREIGN PATENT DOCUMENTS

| | | | |
|---|---|---|---|
| JP | 5468809 | B2 | 4/2014 |
| KR | 10-2014-0000406 | A | 1/2014 |
| KR | 2014-0026135 | A | 3/2014 |

* cited by examiner

-Prior Art-

WATER-COOLED EXHAUST GAS RECIRCULATION COOLER

CROSS-REFERENCE TO RELATED APPLICATION

This application claims the benefit of priority to Korean Patent Application No. 10-2016-0116725 filed in the Korean Intellectual Property Office on Sep. 9, 2016, the entire content of which is incorporated herein by reference.

TECHNICAL FIELD

The present disclosure relates to a water-cooled exhaust gas recirculation (EGR) cooler, which cools exhaust gas recirculated from an exhaust line to an intake line with a coolant, and has an improved supporting structure by using a supporter between tubes.

BACKGROUND

Recently, as an environment problem, such as global warming, has emerged, regulations on exhaust gas have been enhanced, and particularly, a strict standard is applied to the emission quantity of exhaust gas of an automobile.

Particularly, under the EURO-6, in a case of a diesel engine for a car, the quantity of NOx generated needs to be decreased to a level of 80 mg/km, and in this respect, the automobile related companies have adopted new technologies, such as exhaust gas recirculation (EGR), lean NOx trap (LNT), and selective catalyst reduction (SCR).

An EGR device may include a high pressure EGR (HP-EGR) device, which recirculates exhaust gas at a front end of a catalyst, and a low pressure EGR (LP-EGR) device, which recirculates exhaust gas at a rear end of a diesel particle filter (DPF) and recirculates the recirculated exhaust gas to a front end of a turbo charger.

In order to cool the recirculated exhaust gas, an EGR cooler is disposed in an exhaust gas recirculation line, and the EGR cooler may be made of a stainless material having high corrosion resistivity to a high temperature state and condensate water.

However, the EGR cooler made of the stainless material is heavy, has low heat transmission efficiency, and has a poor molding property, and the entire components are expensive. Accordingly, research on the EGR cooler, which has high heat transmission efficiency, has an excellent molding property, and is made of aluminum, and of which components are relatively cheap, has been conducted.

Typically, aluminum A1100 that is based on pure aluminum (A1xxx) and A3003 that is based on aluminum-manganese (A3xxx) are used in a fin and a tube of a heat exchanger, which is a cooler, and a temperature of recirculated exhaust gas is about 550° C.

Further, corrosive ions, such as Cl—, SO42-, and NO3-, exist as a component of condensate water, so that the aluminum-based fin or tube may be damaged in a high temperature environment and a corrosive environment. In this respect, research on an aluminum sheet having high strength and high corrosion resistivity is conducted.

FIG. 5 is a perspective view of a cross-section of a part of a tube applied to an EGR cooler.

Referring to FIG. 5, an EGR cooler includes a tube 200, inside of which exhaust gas passes through, and outside of which a coolant passes through.

The tube 200 includes two sheets, which are disposed while having a predetermined interval, and an embossing 500 protruding inwardly are formed in the sheets. Further, leading portions of the embossing 500, which face each other, are brazed to each other to configure the tube 200.

The EGR cooler has a structure, in which exhaust gas or a coolant passes through an internal space, in which the embossing 500 is formed, and the coolant or the exhaust gas passes through an external space, and a brazed portion 505 of the embossing 500 is corroded by a high temperature and condensate water, so that a leakage is generated, thereby degrading general durability.

The above information disclosed in this Background section is only for enhancement of understanding of the background of the invention, and therefore, it may contain information that does not form the prior art that is already known in this country to a person of ordinary skill in the art.

SUMMARY

The present disclosure has been made in an effort to provide a water cooled EGR cooler, in which a bonded portion of a tube is minimized to decrease corrosion of the bonded portion and an interval between the tubes may be stably and uniformly maintained.

According to an exemplary embodiment of the present disclosure, a water-cooled exhaust gas recirculation (EGR) cooler, which receives exhaust gas from an exhaust line, and recirculates cooled exhaust gas to an intake line, includes: a housing having an exhaust gas inlet, into which exhaust gas for cooling the exhaust gas flows, and an exhaust gas outlet, from which exhaust gas is discharged, and further having a coolant inlet, into which a coolant flows, and a coolant outlet, from which the coolant is discharged; tubes arranged inside the housing with a predetermined interval so that exhaust gas passing from the exhaust gas inlet to the exhaust gas outlet flows inside the tubes; and supporters interposed between the tubes and disposed in a space, in which the coolant flows, to maintain the predetermined interval set between the tubes and support the tubes.

The water-cooled EGR cooler may further include a fin, which is bent in a zigzag form, and is disposed at an internal side of the tubes so that an external surface of the fin is in close contact with an internal surface of the tubes.

The tubes, the fin, and the supporters may be made of aluminum.

The coolant inlet and the coolant outlet may be formed in a longitudinal direction of the housing with a second predetermined interval, and may include a coolant inlet pipe connected to the coolant inlet and a coolant outlet pipe connected to the coolant outlet.

The supporter may include: first members extending in a height direction of the tube, and arranged in a longitudinal direction of the tube with a first set interval; and second members integrally formed with the first members, extending in the longitudinal direction of the tube, and arranged in the height direction of the tube with a second set interval.

The second members may extend to have a straight form in a direction, in which the coolant flows, and the first members may be bent in a zigzag form, and a first surface of one side of the first members may support an external surface of a tube, and a second surface of another side of the first members may support an external surface of another tube to maintain the second set interval between the tubes.

The second members may be in contact with one of the tubes.

The exhaust gas inlet and the exhaust gas outlet may be formed at both sides of one end surface of the housing, and a U-shaped flange, which switches a flow direction of the exhaust gas flowing from one end surface to another end surface, may be disposed in another end surface of the housing.

According to another exemplary embodiment of the present disclosure, a water-cooled exhaust gas recirculation (EGR) cooler, which receives exhaust gas from an exhaust line, and recirculates cooled exhaust gas to an intake line, includes: a housing having an exhaust gas inlet, into which exhaust gas flows, and an exhaust gas outlet, from which exhaust gas is discharged, and further having a coolant inlet, into which a coolant for cooling the exhaust gas flows, and a coolant outlet, from which the coolant is discharged; tubes arranged inside the housing with a predetermined interval so that exhaust gas passing from the exhaust gas inlet to the exhaust gas outlet flows inside the tubes; a fin bent in a zigzag form, and disposed in an internal side of each of the tubes so that an external surface of the fin is in close contact with an internal surface of the tube; and a supporter interposed between the tubes, and having a first surface, which is in contact with one tube, and a second surface, which is in contact with another tube, and disposed in a space, in which the coolant flows, so that the predetermined interval between the tubes is maintained.

The supporter may include: a first member extending in a height direction of the tubes, and arranged in a longitudinal direction of the tubes with a first set interval; and a second member integrally formed with the first member, extending in the longitudinal direction, in which the coolant flows, and arranged in the height direction of the tubes with a second set interval, and the first member may be bent in a zigzag form, and the first surface of the first member may support an external surface of one tube, and the second surface of the first member supports an external surface of another tube to maintain the second set interval between the tubes, and the second member may be in contact with one of the tubes.

The supporter may be made of a sheet, and flow holes, which pass from one surface to the other surface, may be arranged in the supporter with a set interval.

The tubes, the fin, and the supporter may be made of aluminum.

According to the exemplary embodiment of the present disclosure, the supporter is interposed between the tubes to stably fix the tube and decrease a bonded portion, so that it is possible to prevent corrosion due to a coolant or exhaust gas, thereby improving durability of the EGR cooler.

DETAILED DESCRIPTION OF THE EMBODIMENTS

Figure 1:
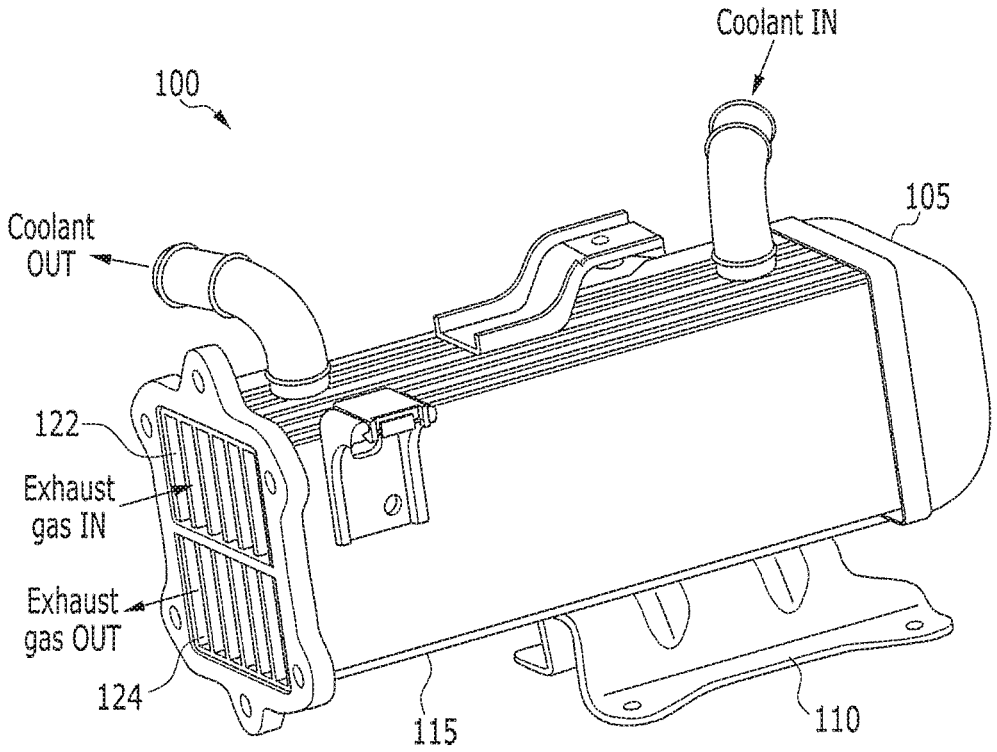
FIG. 1 is a perspective view of an EGR cooler according to an exemplary embodiment of the present disclosure.

Hereinafter, an exemplary embodiment of the present disclosure will be described in detail with reference to the accompanying drawings.

In addition, the size and thickness of each configuration shown in the drawings are arbitrarily shown for understanding and ease of description, but the present disclosure is not limited thereto, and the thickness of layers, films, panels, regions, etc., are exaggerated for clarity.

A part irrelevant to the description will be omitted to clearly describe the present disclosure, and the same elements will be designated by the same reference numerals throughout the specification.

In a description below, names of constituent elements are discriminatingly used as "a first . . . ", a second . . . ", and the like, but this is for discriminating the same name of the constituent element, and the name of the constituent element is not limited to the order.

FIG. 1 is a perspective view of an exhaust gas recirculation (EGR) cooler according to an exemplary embodiment of the present disclosure.

Referring to FIG. 1, an EGR cooler 100 includes a housing 115, a mounting flange 110, and a U-shaped flange 105.

A coolant inlet pipe, into which a coolant flows, is connected to one end at an upper side of the housing 115, and a coolant discharge pipe, through which the coolant is discharged, is connected to the other end at the upper side of the housing 115.

An exhaust gas inlet, into which exhaust gas flows, is formed at an upper portion of one end surface of the housing 115, and an exhaust gas outlet, through which exhaust gas is discharged, is formed at a lower portion of one end surface of the housing 115.

The U-shaped flange 105 is mounted on another end surface of the housing 115, and the U-shaped flange 105 communicates the upper portion and the lower portion of the housing 115.

The exhaust gas supplied from an exhaust line through the exhaust gas inlet 122 of the housing 115 flows to the upper side of the housing 115, passes through the U-shaped flange 105, and flows to the lower side of the housing 115, and is joined to an intake line through the exhaust gas outlet 124.

Further, the mounting flange 110 fixes the housing 115 to one side of an engine.

Figure 2:
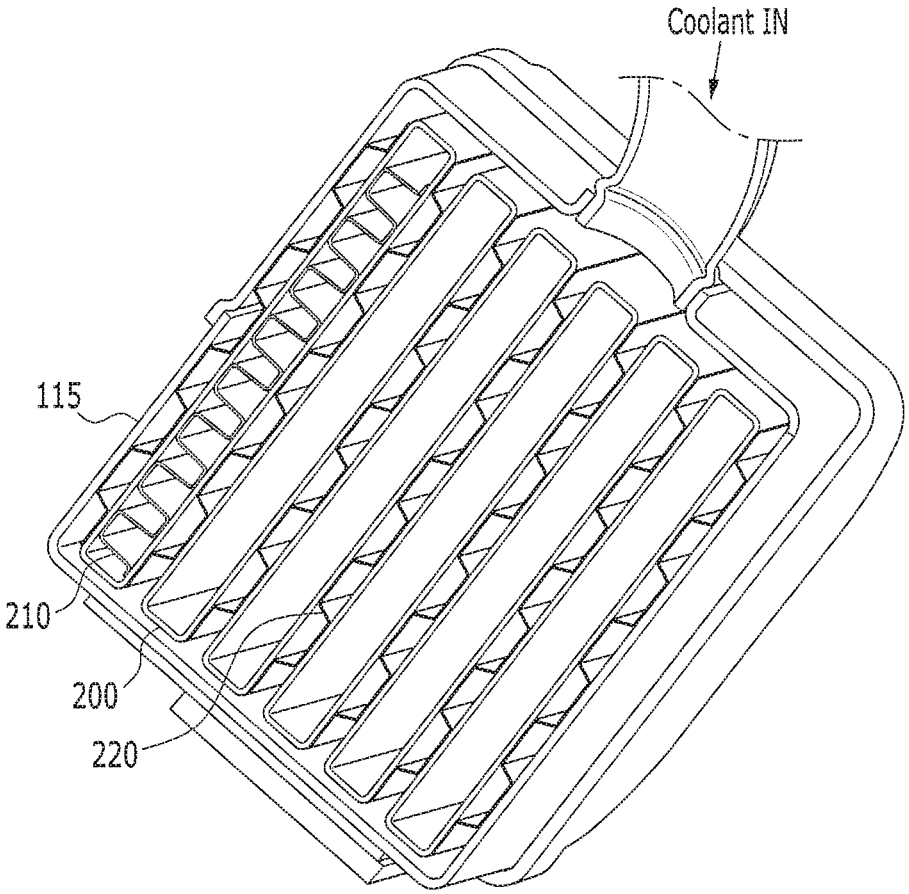
FIG. 2 is a cross-sectional view of the EGR cooler according to the exemplary embodiment of the present disclosure.

FIG. 2 is a cross-sectional view of the EGR cooler according to the exemplary embodiment of the present disclosure.

Referring to FIG. 2, in the EGR cooler 100, tubes 200, fins 210, and supporters 220 are disposed inside the housing 115.

The tube 200 is extended in a longitudinal direction, and is arranged in a width direction with a predetermined interval. Further, a fin 210 is disposed inside the tube 200, and the fin 210 is bent in a zigzag form, and an exterior surface of the fin 210 is in contact with an inner surface of the tube 200.

The tube 200 has a structure, in which exhaust gas passes through an internal side of the tube 200, and a coolant flows in an external side of the tube 200. Further, the fin 210 disposed at the internal side of the tube 200 improves efficiency of heat exchange between the coolant and the exhaust gas.

In the exemplary embodiment of the present disclosure, the supporters 220 are interposed between the tubes 200. The supporters 220 maintain a predetermined interval between the tubes 200, and form a path, in which the coolant flows, between the tubes 200.

Figure 3:
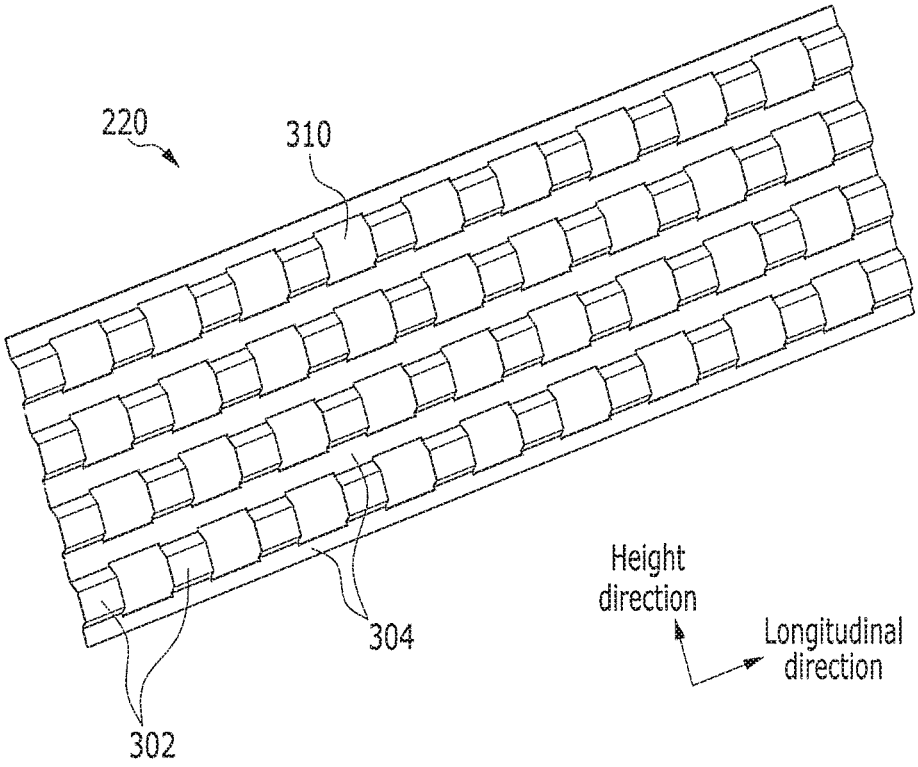
FIG. 3 is a perspective view of a supporter applied to the EGR cooler according to the exemplary embodiment of the present invention.

FIG. 3 is a perspective view of a supporter applied to the EGR cooler according to the exemplary embodiment of the present disclosure. Referring to FIG. 3, the supporter 220 includes first members 302 and second members 304.

The first members 302 are extended in a height direction and are bent in a zigzag form, and are arranged in a longitudinal direction with a predetermined interval.

The second members 304 are extended in a longitudinal direction and have a straight form, and are arranged in a height direction with a predetermined interval.

Further, the first and second members 302 and 304 are integrally formed, and flow holes 310 are formed by the gaps of the first and second members 302 and 304, and the flow holes 310 are arranged in a longitudinal direction and the height direction with predetermined intervals.

In the exemplary embodiment of the present disclosure, the flow holes 310 may be formed in one sheet with a predetermined interval, and the first and second members 302 and 304 may be integrally formed with the sheet by pressing the first and second members 302 and 304 and the sheet.

Further, the second member 304 may be formed in a direction, in which a coolant flows, and have a straight form, thereby decreasing flow resistance of the coolant.

Figure 4:
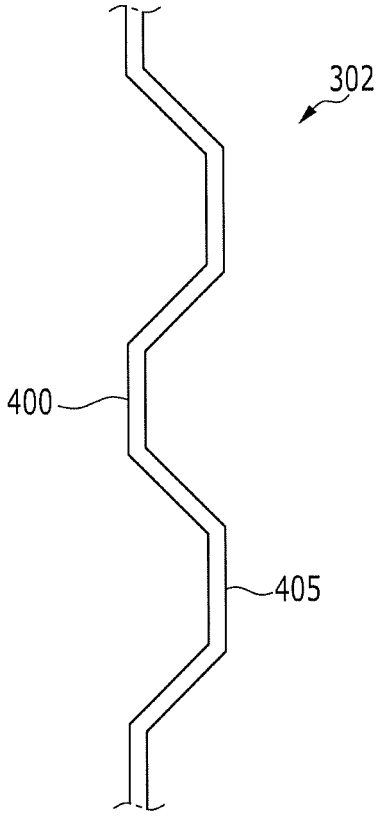
FIG. 4 is a cross-sectional view of the part of the supporter according to the exemplary embodiment of the present disclosure.
Figure 5:
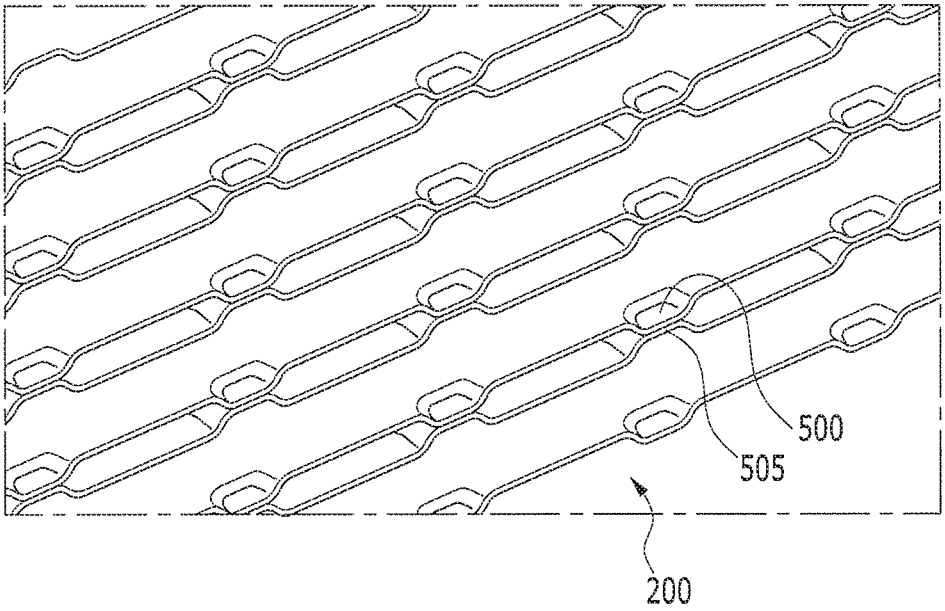
FIG. 5 is a perspective view of a cross-section of a part of a tube applied to an EGR cooler according to the prior art.

FIG. 4 is a cross-sectional view of the part of the supporter according to the exemplary embodiment of the present disclosure.

Referring to FIG. 4, the first member 302 of the supporter 220 is bent in a zigzag form, a first surface 405 formed at an external side of one surface is in contact with one of the tubes 200, and a second surface 400 formed at an external side of the other surface is in contact with another one of the tubes 200.

The first and second surfaces 405 and 400 of the supporter 220 are in contact with the tubes 200, thereby improving cooling efficiency, and stably supporting the tubes 200.

While this invention has been described in connection with what is presently considered to be practical example embodiments, it is to be understood that the invention is not limited to the disclosed embodiments. On the contrary, it is intended to cover various modifications and equivalent arrangements included within the spirit and scope of the appended claims.

What is claimed is:

1. A water-cooled exhaust gas recirculation (EGR) cooler, which receives exhaust gas from an exhaust line and recirculates cooled exhaust gas to an intake line, the water-cooled EGR cooler comprising:

a housing having an exhaust gas inlet, into which exhaust gas flows, and an exhaust gas outlet, from which exhaust gas is discharged, the housing further having a coolant inlet, into which a coolant for cooling the exhaust gas flows, and a coolant outlet, from which the coolant is discharged;

tubes, each of which has an enclosed tube shape, arranged inside the housing with a first predetermined interval so that exhaust gas passing from the exhaust gas inlet to the exhaust gas outlet flows inside the tubes; and supporters interposed between the tubes to maintain the first predetermined interval between the tubes and to support the tubes, and disposed in a space, in which the coolant flows, wherein each of the supporters has a bent sheet shape in a zigzag form in a height direction and in a longitudinal direction of the tubes, and flow holes, which pass from one side to another side of each of the supporters, are spaced apart from each other in the height direction and in the longitudinal direction, wherein each of the supporters includes:

first members extending in the height direction of the tubes, and arranged in the longitudinal direction of the tubes with a first set interval; and second members integrally connected with the first members, extending in the longitudinal direction of the tubes, and arranged in the height direction of the tubes with a second set interval, wherein each of the first members includes:

a first surface at an external side of one surface such that the first surface is in contact with one of the tubes; and a second surface at an external side of another surface such that the second surface is in contact with another one of the tubes, and wherein the flow holes are openings arranged between adjacent first members in the longitudinal direction and extending from the first surface to the second surface.

2. The water-cooled EGR cooler of claim 1, further comprising:

a fin disposed at an internal side of each of the tubes, bent in a zigzag form, and having an external surface that is in close contact with an internal surface of each of the tubes.

3. The water-cooled EGR cooler of claim 2, wherein:

the tubes, the fin, and the supporters are made of aluminum.

4. The water-cooled EGR cooler of claim 2, wherein:

the coolant inlet and the coolant outlet are formed in a longitudinal direction of the housing with a second predetermined interval; and a coolant inlet pipe and a coolant outlet pipe are connected to the coolant inlet and the coolant outlet, respectively.

5. The water-cooled EGR cooler of claim 1, wherein:

each of the second members has a straight form in a direction in which the coolant flows;

each of the first members is bent in a zigzag form; and the first surface of each of the first members supports an external surface of one tube, and the second surface of each of the second members supports an external surface of another tube to maintain the first predetermined interval between the tubes.

6. The water-cooled EGR cooler of claim 5, wherein:

the second members are in contact with one of the tubes disposed at one side of the supporters and another side of the supporters.

7. The water-cooled EGR cooler of claim 1, wherein:

the exhaust gas inlet and the exhaust gas outlet are formed at both sides of one end surface of the housing; and a U-shaped flange, which switches a flow direction of the exhaust gas, is disposed at another end surface of the housing.

8. A water-cooled exhaust gas recirculation (EGR) cooler, which receives exhaust gas from an exhaust line and recirculates cooled exhaust gas to an intake line, the water-cooled EGR cooler comprising:

a housing having an exhaust gas inlet, into which exhaust gas flows, and an exhaust gas outlet, from which exhaust gas is discharged, the housing further having a coolant inlet, into which a coolant for cooling the exhaust gas flows, and a coolant outlet, from which the coolant is discharged;

tubes, each of which has an enclosed tube shape, arranged inside the housing with a predetermined interval so that exhaust gas passing from the exhaust gas inlet to the exhaust gas outlet flows inside the tubes;

a fin bent in a zigzag form, and disposed in an internal side of each of the tubes so that an external surface of the fin is in close contact with an internal surface of each of the tubes; and a supporter interposed between the tubes, the supporter having a first surface, which is in contact with a tube, and a second surface, which is in contact with another tube, wherein the supporter is disposed in a space, in which the coolant flows, so that the predetermined interval between the tubes is maintained, wherein the supporter has a bent sheet shape in a zigzag form in a height direction and in a longitudinal direction of the tubes, and flow holes, which pass from one side to another side of the supporter, are spaced apart from each other in the height direction and in the longitudinal direction, wherein the supporter includes:

first members extending in the height direction of the tubes, and arranged in the longitudinal direction of the tubes with a first set interval; and second members integrally connected with the first members, extending in the longitudinal direction of the tubes, and arranged in the height direction of the tubes with a second set interval, wherein the first surface, which is on an external side of one surface of each of the first members, is in contact with one of the tubes, and the second surface, which is on an external side of another surface, is in contact with another one of the tubes, and wherein the flow holes are openings arranged between adjacent first members in the longitudinal direction and extending from the first surface to the second surface.

9. The water-cooled EGR cooler of claim 8, wherein the first member is bent in a zigzag form, and the first surface of one side of the first member supports an external surface of one tube, and the second surface of another side of the first member supports an external surface of another tube to maintain the predetermined interval between the tubes, and the second member is in contact with one of the tubes.

10. The water-cooled EGR cooler of claim 8, wherein:

the tubes, the fin, and the supporter are made of aluminum.

* * * * *